US008657766B2

(12) United States Patent
Tuck et al.

(10) Patent No.: US 8,657,766 B2
(45) Date of Patent: Feb. 25, 2014

(54) VIBRATOR APPARATUS WITH AUDIO AND MOTOR CONTROL FEATURES

(76) Inventors: Cleve R. Tuck, Longmont, CO (US); Court H. Tuck, Longmont, CO (US); Lance Carlson, Niwot, CO (US); Joseph R. Chughtai, Longmont, CO (US)

( * ) Notice: Subject to any disclaimer, the term of this patent is extended or adjusted under 35 U.S.C. 154(b) by 554 days.

(21) Appl. No.: 12/930,524

(22) Filed: Jan. 10, 2011

(65) Prior Publication Data

US 2012/0179077 A1 Jul. 12, 2012

(51) Int. Cl.
*A61H 1/00* (2006.01)
*A61H 19/00* (2006.01)

(52) U.S. Cl.
USPC ..... 601/47; 601/46; 600/38

(58) Field of Classification Search
USPC ..... 601/46, 47, 67, 69, 70, 72, 80, 84, 89, 601/93, 107, 108; 600/38
See application file for complete search history.

(56) References Cited

U.S. PATENT DOCUMENTS

| | | | | |
|---|---|---|---|---|
| 5,928,170 | A | 7/1999 | Garrigan | |
| 5,951,500 | A * | 9/1999 | Cutler | 601/47 |
| 6,027,463 | A * | 2/2000 | Moriyasu | 601/46 |
| 6,592,516 | B2 | 7/2003 | Lee | |
| 2002/0133102 | A1 | 9/2002 | Quan | |
| 2003/0162595 | A1 | 8/2003 | Serbanescu | |
| 2004/0097852 | A1 | 5/2004 | Boyd et al. | |
| 2006/0084837 | A1 | 4/2006 | Klearman et al. | |
| 2007/0055096 | A1 | 3/2007 | Berry et al. | |
| 2007/0244416 | A1 | 10/2007 | Sobin et al. | |
| 2008/0119767 | A1 * | 5/2008 | Berry et al. | 601/46 |
| 2010/0087757 | A1 | 4/2010 | Hoffman et al. | |
| 2010/0174213 | A1 | 7/2010 | Shim | |

OTHER PUBLICATIONS

OHMIBOD; seven (7) product description website pages from www.ohimibod.com; accessed and printed Mar. 8, 2011; unknown date of first publication; Suki, LLC, USA.

* cited by examiner

*Primary Examiner* — Quang D Thanh
(74) *Attorney, Agent, or Firm* — Rod D. Baker

(57) ABSTRACT

A means and method for arbitrarily coordinating a tactile vibratory stimulus with an audio stimulus. There is provided an adult-type sex toy, and associated method, with a vibrator and audio player in which the audio player is augmented with additional circuitry and firmware, such that the audio player is in signal communication with the vibrator to to control the speed of the vibrator motor. The motor speed, however, is not correlated with raw audio signal strength or frequency. Rather, the vibrator motor speed is regulated by motor speed information embedded with the audio file being played back. Accordingly, the apparatus audio player can play back an erotic story, for example, while automatically coordinating the vibrator motor speed in concert with the perceived content of the audible story as heard by the user-listener.

20 Claims, 7 Drawing Sheets

FIG. 4

| Time (sec) | Motor Speed Value | Speed (%) | Speed Change? |
|---|---|---|---|
| 0.0 | 0 | 0.00% | |
| 0.1 | 0 | 0.00% | |
| 0.2 | 0 | 0.00% | |
| 0.3 | 0 | 0.00% | |
| 0.4 | 0 | 0.00% | |
| 0.5 | 0 | 0.00% | |
| 0.6 | 0 | 0.00% | |
| 0.7 | 121 | 12.10% | yes |
| 0.8 | 121 | 12.10% | |
| 0.9 | 121 | 12.10% | |
| 1.0 | 121 | 12.10% | |
| 1.1 | 149 | 14.90% | yes |
| 1.2 | 149 | 14.90% | |
| 1.3 | 149 | 14.90% | |
| 1.4 | 149 | 14.90% | |
| 1.5 | 149 | 14.90% | |
| 1.6 | 149 | 14.90% | |
| 1.7 | 149 | 14.90% | |
| 1.8 | 149 | 14.90% | |
| 1.9 | 383 | 38.30% | yes |
| 2.0 | 383 | 38.30% | |
| 2.1 | 383 | 38.30% | |
| 2.2 | 383 | 38.30% | |
| 2.3 | 383 | 38.30% | |
| 2.4 | 383 | 38.30% | |
| 2.5 | 383 | 38.30% | |
| 2.6 | 383 | 38.30% | |
| 2.7 | 383 | 38.30% | |
| 2.8 | 383 | 38.30% | |
| 2.9 | 383 | 38.30% | |
| 3.0 | 844 | 84.40% | yes |
| 3.1 | 844 | 84.40% | |
| 3.2 | 844 | 84.40% | |
| 3.3 | 844 | 84.40% | |
| 3.4 | 844 | 84.40% | |
| 3.5 | 844 | 84.40% | |
| 3.6 | 844 | 84.40% | |
| 3.7 | 398 | 39.80% | yes |
| 3.8 | 398 | 39.80% | |
| 3.9 | 398 | 39.80% | |
| 4.0 | 398 | 39.80% | |
| 4.1 | 398 | 39.80% | |
| 4.2 | 398 | 39.80% | |
| 4.3 | 398 | 39.80% | |
| 4.4 | 398 | 39.80% | |
| 4.5 | 369 | 36.90% | yes |
| 4.6 | 369 | 36.90% | |
| 4.7 | 369 | 36.90% | |
| 4.8 | 369 | 36.90% | |
| 4.9 | 348 | 34.80% | yes |
| 5.0 | 348 | 34.80% | |
| 5.1 | 43 | 4.30% | yes |
| 5.2 | 43 | 4.30% | |
| 5.3 | 43 | 4.30% | |

| Time (sec) | New Motor Speed Value |
|---|---|
| 0.0 | 0 |
| 0.7 | 121 |
| 1.1 | 149 |
| 1.9 | 383 |
| 3.0 | 844 |
| 3.7 | 398 |
| 4.5 | 369 |
| 4.9 | 348 |
| 5.1 | 43 |

VIBRATOR APPARATUS WITH AUDIO AND MOTOR CONTROL FEATURES

BACKGROUND OF THE INVENTION

1. Field of the Invention

The present invention relates generally to vibrator devices with accompanying audio capabilities, particularly to vibrators for sexual stimulation which also include audio features, and specifically to such a stimulation device in which the vibration function is specially correlated to the audio function.

2. Description of the Prior Art

It is known to have a phallic-shaped device, sometimes called a "dildo," for use in sexual activity. Such devices frequently are shaped, and sometimes sized, generally to resemble a human penis, the degrees of realism in size and appearance varying considerably in the art. These devices ordinarily are fabricated from, or covered with, a variety of material compositions to permit their pleasant contact with a user's skin and sensitive body parts. It also is known to dispose internally within such devices a motorized vibrator, to impart a controllable vibrating movement to the device. The device's vibration allows it to be used to massage body parts (sexual and non-sexual) to enhance the erotic experience and boost sexual stimulation.

Most sex-toy type vibrators have simple on-off switches, and/or a simple motor speed control such as a single switch which cycles through several different speeds, for manually controlling the speed of the vibrator motor. Existing vibrator devices generally have only a limited manual motor speed control by means of the user's pushing or turning of buttons, and feature no audio playback at all.

Some vibrators are known which respond (change vibrator motor speed) directly to the intensity of a musical audio input. In such devices, the volume and beat of the music determines the strength of the vibrations; the motor response is a function solely of the intensity of the source audio signal. One commercially available vibrator device having audio functions is offered on the Internet at www.ohmibod.com. In devices of this general type, a separate music player is connected into the product (or the product may have a microphone). The music player has a costly and powerful microprocessor of some type, yet the device also must use a relatively complex and costly circuitry (probably also including a second microprocessor) to analyze the incoming sound. Therefore there are two microprocessors of some kind, and circuitry to process/analyze the fundamental characteristics of the waveform of the incoming audio signal.

Certain other devices are known which have both audio listening and vibrator functions for purposes of enhancing sexual enjoyment. Such devices are typified by the disclosures of U.S. Pat. No. 5,928,170 to Garrigan; U.S. Patent Application Publication No. 2003/0162595 by Serbanescu; U.S. Patent Application Publication No. 2004/0097852 by Boyd et al.; U.S. Patent Application Publication No. 2006/0084837 by Klearman et al.; and U.S. Patent Application Publication No. 2007/0055096 by Berry et al. The entire disclosures of these foregoing patent and patent publications serve as broad background to the present disclosure, and the entireties thereof are incorporated herein by reference.

Thus, in many devices that have audio playback capability, the audio output heard by the user is independent of the vibrator motor speed. In certain other known devices, the motor speed is responsive only to the physics (usually signal strength or frequency) of the audio source. Thus, the motor speed control cannot be coordinated with an audio track (such as a story) in an arbitrary manner; rather it is merely responsive to general characteristics of the objective audio waveform. Ordinarily, when the audio source becomes loud, the motor speed increases. This is always how the device responds; when the audio is loud, the motor speed is high—there is no provision for other modes of control such that the motor speed may be, for example, fast during one loud portion of the audio, and slow during another equally loud portion.

There is a need in the art for a vibrator apparatus in which the vibrator motor speed is arbitrarily coordinated with the content (such as the subjective meanings in a spoken narrative) of the audio playback.

Against the foregoing background, the current invention was developed.

SUMMARY OF THE INVENTION

There is disclosed hereby an apparatus and method whereby a tactile stimulation (e.g., a vibration) is provided simultaneously with an acoustical stimulation (e.g., audio soundtrack) for the enjoyment of the user. A preferred embodiment is an adult-type sex toy with a vibrator and audio player (e.g., similar to a MP3 player) in which the audio player is augmented with additional circuitry and firmware, such that the audio player is in signal communication with the vibrator to control the speed of the vibrator motor. The motor speed, however, is not correlated with raw incoming audio signal strength or frequency. Rather, the vibrator motor speed is regulated by motor speed information embedded with the audio file being played back. Accordingly, the apparatus audio player can play back an erotic story, for example, while automatically coordinating the vibrator motor speed in concert with the messages within audible story. The motor response thus is arbitrary, in that it is not a function of the audio signal waveform, but rather is regulated by the preselected motor speed information which is not a function of the audio signal per se.

BRIEF DESCRIPTION OF THE DRAWINGS

The accompanying drawings, which are incorporated into and form a part of the specification, illustrate a preferred embodiment of the present invention and, together with the written description, serve to explain the principles of the invention. The drawings are only for the purpose of illustrating the invention generally and are not to be construed as limiting the invention. In the drawings:

FIG. 4 is a table showing motor speed information according to the present disclosure, there being a tabular correlation of cumulative elapsed times, motor speed values, motor speed as a percentage of full speed, and speed change indications;

Figure 1:
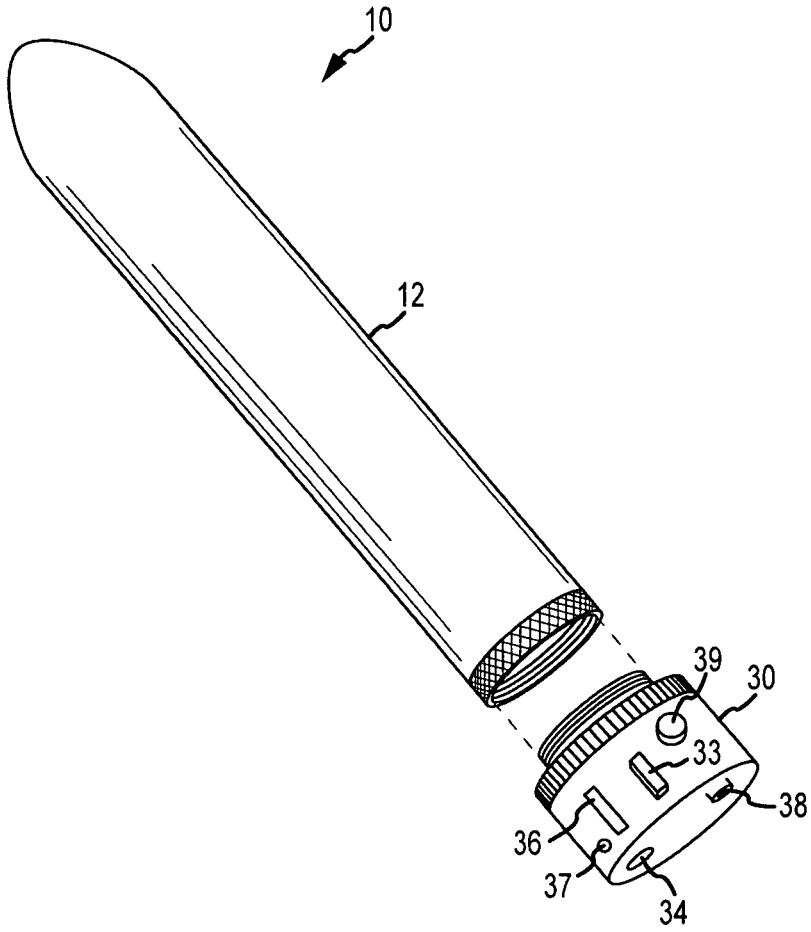
FIG. 1 is a perspective, partially exploded, side view of a preferred embodiment of an apparatus according to this disclosure.

The same label numerals are used to identify the same or similar items throughout the various views.

DETAILED DESCRIPTION OF A PREFERRED EMBODIMENT

Best Mode for Practicing the Invention

There is disclosed hereby a vibrator apparatus, and related methods, especially of the type sometimes used by persons engaged in sexual activity. The preferred embodiment of the present apparatus perhaps is best suited for women to use while masturbating, but certainly is not so limited in its utility. It should be immediately understood that the general concepts and components of the following description may also find utility in other apparatuses, besides adult sex toys, in which it is desired to coordinate arbitrarily an audio playback with the speed of a vibrator motor. For example, but not by limitation, the general description that follows may find beneficial application in therapeutic or relaxing massage devices generally, vibrating lounge chairs or the like, or in non-sexually-oriented toys or novelties. Thus, the scope of the invention extends broadly to an apparatus for providing simultaneous vibration (tactile) and sound (listening) sensory stimulation, but in which the tactile and listening stimuli are coordinated independently from fundamental characteristics of the audio data.

The apparatus includes in one embodiment a vibrator electronically connected with an audio player for playing back a pre-recorded soundtrack for transmission to headphones, earphones, or speakers. The vibrator apparatus with audio player features a microprocessor programmable to coordinate the speed of the vibrator with pre-selected corresponding episodes of the audio soundtrack. A single microprocessor, or more precisely a microcontroller (an integrated circuit which contains a microprocessor plus additional useful peripheral functions like memory, timers, analog to digital converters, and the like), provides a music player function and a motor speed control function. The microcontroller is sufficiently powerful, and contains the necessary peripheral components (which would be well known to those skilled in the art), to perform audio playback and motor speed control such that both audio playback and motor speed control occur simultaneously. The apparatus and method can operate using a single microcontroller (as opposed to two or more separate microcontrollers), if desired, to both provide the audio player function and the motor control function—a simple, affordable solution enabled by embedding precise motor speed control information into a digital file which can be directly read by the microcontroller. Elimination from the present apparatus of any circuitry needed to analyze an incoming audio signal, as may be found in certain known vibrators with playback functions, offers savings in costs and complexity.

In a preferred embodiment, the pre-recorded audio soundtrack is played back into the earphones to tell an erotic "story," such as a narrative by a male voice, with or without an accompanying musical background. The soundtrack is divided into time intervals, or is embedded with motor-speed change signals, so that the microprocessor coordinates speed changes in the vibrator with certain story features (i.e., the "racier" the narrative, the faster the vibrator runs). Various different stories are available for uploading into the apparatus (e.g., using a USB "flash" drive), so that the user can select from among a variety of narratives and narrators.

Thus there is provided a vibrator apparatus and method in which the vibrator motor speed is arbitrarily coordinated with the content of an audio playback. The coordination is arbitrary in the sense that the motor speed is not a function directly of the physical waveform of the audio signal that is played back. The frequency, amplitude, strength, etc., of the audio signal does not determine the motor speed, so the timing of motor speed changes, in relation to the audio signal characteristics, is not a function of the physics of the audio signal. Rather, it is possible per this apparatus and method to provide an arbitrary relationship between the vibrator response and the audio playback, that is, by running a digital file containing audio and motor speed information in which the relationship between the audio playback and the vibrator motor speed is whatever the creator of the digital file wants that relationship to be. The correlation is independent of the fundamental audio characteristics of the playback, and thus is objectively "arbitrary."

What preferably is coordinated, in one preferred embodiment, is the motor speed and the subjective content of the audio file as perceived by the listener. Thus, if the audio play-back is a story, the motor speed changes are coordinated with the conveyed meanings and suggestions of the spoken narrative. Similarly, a solely musical soundtrack could be coordinated with vibrator motor speed changes, whereby the vibrator motor speed is related to the subjective character (e.g., peaceful, jazzy, dramatic, cheerful, etc., as distinguished from objective meters such as the beat) of the perceived music at any particular time. In the preferred embodiment, motor speed control information is combined with audio information (i.e., an audio "track") into a single coordinated file. Alternatively, two separate files could be employed; one file containing the motor speed information and the other the audio track, provided one or both files also includes coordinating information or routines to "match" the running of the files. The apparatus thus can play audio while simultaneously and automatically controlling/modulating the speed of the vibrator motor.

The overall apparatus of this disclosed invention shares with known adult vibrator devices some generic attributes. However, the disclosed apparatus advantageously uses a "story file" digital file combining motor speed control information with an audio track (spoken story, though it could be solely music). The motor speed profile can be arbitrarily coordinated with the soundtrack (story or music), and as a result the speed control is specific: the author/editor of the story file can pre-set the motor's vibration speed to be any value (within the functional limits of the motor assembly) at any point of the audio playback. Motor speed is controlled independently of the audio signal strength or waveform amplitude/frequency. Accordingly, the coordination between the motor speed and the audio playback can be whatever the author of the story file may select it to be. To thus coordinate arbitrarily the motor operating speed with a content of the soundtrack, in accordance with the disclosed apparatus and method, is to supply the soundtrack with motor speed instructional data/information in any selected relationship desired, without regard for the fundamental acoustical characteristics of the audio signal itself.

In a preferred embodiment, the story file is composed so to coordinate the motor speed with, for example, the subjective audible content of the playback. By thus coordinating the motor speed and audio playback, the invention offers a significant advantage and unique differentiation in a vibrator apparatus; the user can listen to a story while enjoying a vibrator response that is coordinated with the story's subjective content.

Figure 2:
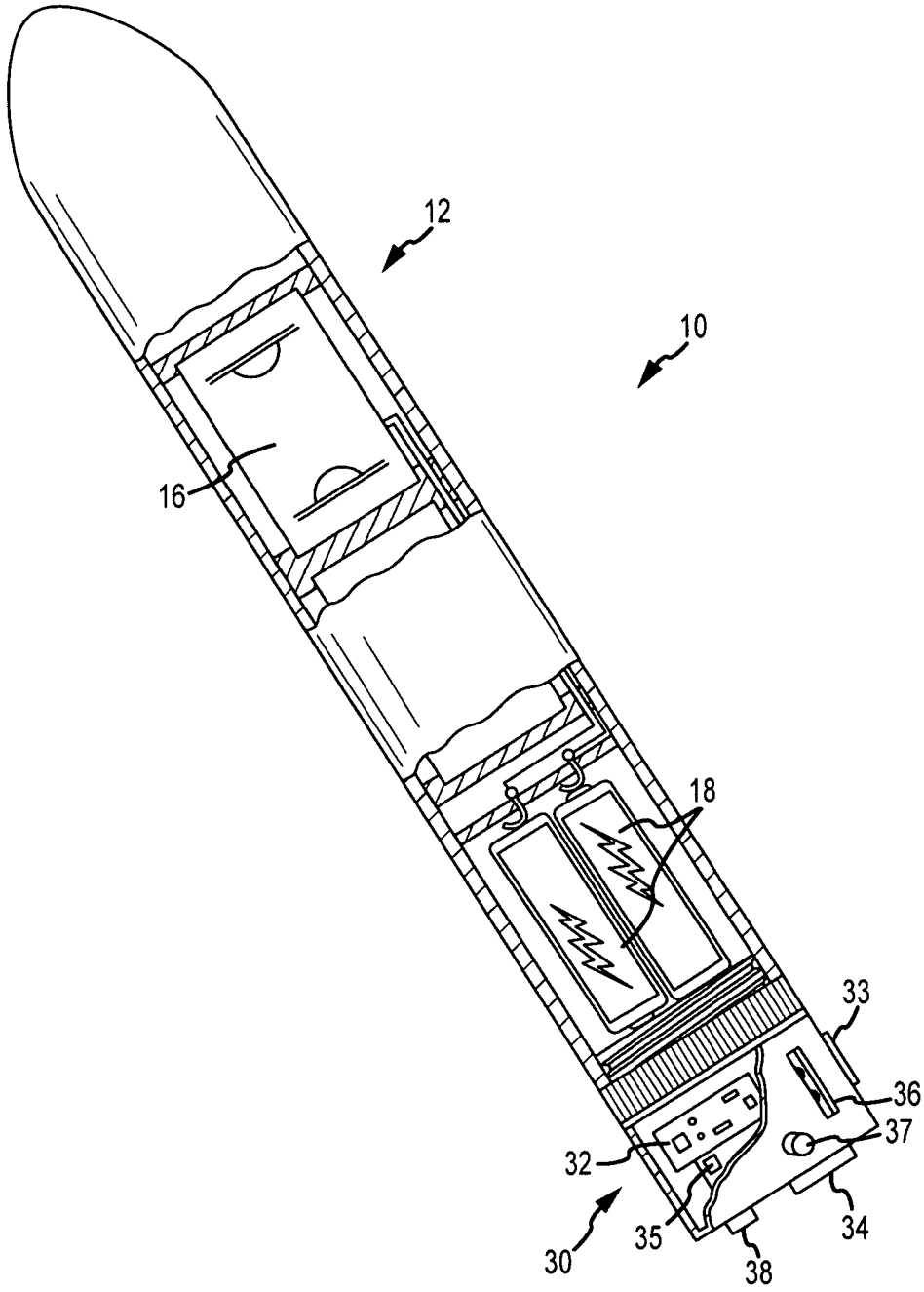
FIG. 2 is a perspective view of the embodiment seen in FIG. 1, showing the base portion and the cap portion of the apparatus attached together, and with portions of the base and cap portions "broken away" to reveal certain interior components.

Referring to FIGS. 1 and 2, it is seen that the vibrator unit 10 of one embodiment of the apparatus has a somewhat hollow base portion 12 and a cap portion 30. The cap portion 30 is removably connectable to the proximate end of the base portion 12 in any suitable manner—conventionally, the cap portion and the base portion have complementary screw threads, so that the cap portion can be removably screwed upon the base portion. A gasket or O-ring (not shown) may be provided as known in the art to provide for a water-tight seal between the cap and base portions when fully connected together. Very generally, and subject to the detailed descriptions of the apparatus yet to follow, the configurations of the base portion 12 and the cap portion 30 are similar to those elements found in known adult vibrator-type devices.

The base portion 12 in the preferred embodiment of the vibrator unit 10 includes a housing which contains at least one vibrator motor 16 and battery(s) 18. The base portion 12 preferably but not necessarily is phallic-shaped in a manner familiar in the art, and its exterior is fabricated using, and/or covered with, materials (typically any of various types of synthetic rubbers or plastics), known for providing pleasurable, non-irritating contact with the skin.

FIG. 1 shows that the cap portion 30 attaches to the proximate end of the base portion, and in the preferred embodiment contains or mounts, and protects, various functional components of the vibrator unit 10. In addition to several components pertaining to the innovative aspects of the apparatus, the cap portion 30 may include some components which occur in erotic vibrator devices known in the art, such an on/off switch and simple, manually actuated motor speed control (low, medium, high speed) elements, to permit operation of the vibrator unit in a conventional manner, without running the audio feature. There is provided on the cap portion 30 a power/stop button 33. The power/stop button 33 is operated by the touch of a finger, and is available commercially. Long presses (e.g., of more than approximately 1.5 seconds duration) of the power/stop button 33 by the user alternately powers on and off the complete vibrator unit 10. A short depression (e.g., about 1.5 seconds or less) of the power/stop button 33 during audio story playback operates to stop and reset the playback to the beginning of the story. There preferably also is provided on the cap portion 30 a play/pause button 34 which starts/restores audio playback, and which when manipulated by the user also temporarily pauses the playback. All the buttons of the apparatus preferably are simple momentary contact buttons as are in commonly use on portable electronic devices such as MP3 music players.

Various button types known in the art may be advantageously employed in the apparatus to enhance user control, without departing from the scope of the invention. Button functions on the vibrator unit 10 could be enhanced (or additional buttons could be added to the apparatus) to provide the means for the user to manually control the vibrator motor speed, and/or override the motor control from the story file. Moreover, button functions could be enhanced (or additional buttons could be added to the apparatus) to provide fast-forward and rewind functions, thus offering the user more comprehensive control over story playback. Also, the function of buttons 33, 34 may be enhanced by incorporating button types responsive to different manual presses: long versus short presses (preferably implemented on the power/stop button 33), quick double-presses, or the like.

Figure 8:
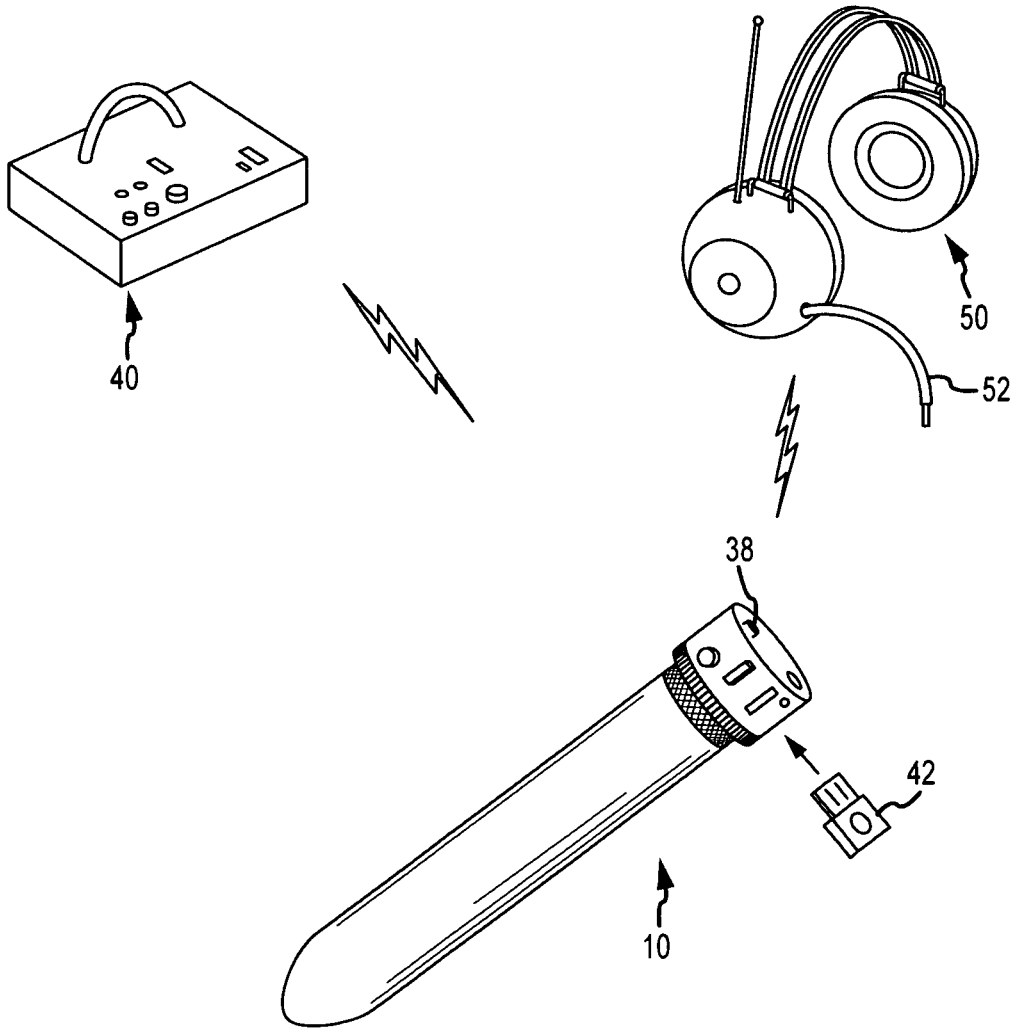
FIG. 8 is a perspective view of an embodiment of the apparatus according to the present disclosure, in which there is a wireless communication between the vibrator, a base console, and audio headphones.

Also on or in the cap portion 30 of the preferred embodiment is a USB or similar connection dock or port 36 of conventional configuration for providing a mechanical and electronic connection between a known type of portable "flash drive" (e.g., USB-type "thumb drive") and the cap portion 30. When removably installed into the port 36, a portable flash drive is in electronic communication with an internal circuit board 32 (FIG. 2). A headphone connector 38 preferably is provided on the cap portion 30, for connecting headphones 50, or earphones, an audio input of a stereo system, or conventional self-powered speakers to the vibrator unit 10 via known wiring systems 52 (FIG. 8). Headphone connector 38 is known in the electronics art for placing a set of headphones, or an audio input of a stereo system or self-powered speakers, in signal communication with the other apparatus electronics, whereby audio playback occurs through the headphone speaker(s), or an audio input of a stereo system or self-powered speakers, for the enjoyment of the user. Also in communication with the other apparatus electronics is a light-emitting diode (LED) indicator 37 for providing visual process feedback to the user, as shall be described further.

The cap portion 30 preferably but optionally mounts one or more volume control buttons 39 by which the user may manually regulate the perceived audio volume of the audio playback. It is possible, for example, to employ two volume control buttons: one button for volume-up and another one for volume-down, as is frequently the case for known audio equipment where volume is controlled by push-buttons rather than rotating potentiometers. If a volume control button 39 is not provided on the cap portion 30 of the apparatus, the removably connected headphones/earphones/speakers can be of a commonly available type which includes a volume control. As seen in FIG. 8, the headphones 50 (or speakers or the like) may be of a known type having an antenna and integrated receiver (radio, IR, or the like) to permit wireless communication from the vibrator unit 10 (and/or conceivably, a separate base console 40). A user may plug in some portable speakers and thus be freed from wires leading to her headphones.

The locations and arrangements of buttons 33, 34, ports 36, etc., are depicted in the drawings by way of illustrative example only. One skilled in the art readily appreciates that the locations and arrangements of these components can differ between versions of the apparatus, and such physical positions and relationships may be determined according to factors of convenience, ease of use, and ease of manufacture.

The communication between the vibrator unit 10 and a set of speakers (headphones 50 or similar audio component) is not limited to the use of a wired connection via the headphone connector 38. Wireless transmission technologies known in the art (for example RF, infrared, or the like) alternatively could be employed to communicate audio signals from the vibrator unit 10 to an earphone or headphone 50 in use. Likewise, alternative means, besides a USB flash drive, could be used for transmitting a story file into the apparatus. The apparatus could be adapted to receive alternative memory devices known in the art (e.g., MultiMedia Card, SD, or SDmicro portable memory devices). Or, a wireless transmission could be utilized, including a wireless connection to a network or the Internet. A story file accordingly could be transmitted, for example, from a remotely located console 40 including a transmitter to a receiver 35 in the vibrator unit 10.

FIG. 2 illustrates that the cap portion 30 in the preferred embodiment of the vibrator unit 10 contains a circuit board 32 which contains the microprocessor-based audio playback and motor control electronics components. The cap 30 may also house one or more transmitter/receiver devices 35 of any suitable known type for permitting wireless communications between the vibrator unit 10 and other components of a completed system in alternative embodiments (FIG. 8). The control circuit of the circuit board 32 preferably includes a non-volatile internal memory, preferably at least 8 MB (sufficient to provide about 20 minute's story playback time). In possible alternative embodiments the internal non-volatile memory could be eliminated, and the story file played back directly from an externally connected memory device (e.g., the USB flash drive) in operative connection with the connection port 36 or the story file could be played back directly from a remotely located console 40 (i.e., FIG. 8). FIG. 2 illustrates other portions of the vibrator unit 10 "broken away" to reveal a possible arrangement of the batteries 18 and vibrator motor 16 within the base portion 12.

The base portion 12 of the apparatus is substantially comparable to analogous portions of standard, commercially available vibrator devices. Housed in the base portion 12 are the batteries 18 and at least one vibrator motor 16; the batteries and motor have signal connections to the components of the cap portion, conventionally: battery (positive), battery (negative), and motor drive. There are in a preferred embodiment of the apparatus two AA batteries 18, so the voltage between battery (positive) and battery (negative) signal connections is approximately 3.0V (which will change as batteries discharge). The voltage applied to the motor drive signal contact determines the speed of the vibrator motor(s) 16. This signal contact is referenced to the battery (positive) signal, so that when the motor drive signal contact voltage equals the battery (positive) voltage, the motor speed is zero. When the motor drive signal voltage is driven to the battery (negative) voltage, the motor speed is maximized. Motor speed will be intermediate at intermediate voltages on the motor drive contact, in an approximately proportional manner. These three electrical signals therefore are simultaneously able to provide power to the circuit board 32 and control the speed of the vibrator motor(s) 16.

For simplicity of illustration, a single vibrator motor 16 is shown in FIG. 2. It is to be understood that more than one vibrator motor could be utilized in alternative embodiments of an apparatus 10. For example, more sophisticated versions of adult sex vibrators have an auxiliary appendage or "tickler" that extends from the main body of the device to provide for separate, focused stimulation of the female clitoris. Such a tickler is not shown in the figures, but is well-known in the art. Accordingly, a second vibrator motor 16 could be provided in the base portion 12 and adapted to impart independent motion (e.g., oscillation or rotation) to such a tickler, apart from the vibration imparted to the main base portion 12 of the vibrator unit by the action of a first vibrator motor.

While apparatus battery signal circuitry functions generally as described above, one skilled in the art will understand that other signal combinations can accomplish the same results. For example, there may be the same three signals, except the motor drive signal could be referenced to the negative battery signal instead of the positive battery. Alternatively, there could be four signals: battery (positive), battery (negative), and two motor drive signals (such as motor positive and motor negative).

It should be noted that the foregoing description of the general physical configuration of the vibrator unit 10 is of a preferred embodiment only; other alternative embodiments are possible. For example, the various functional parts could be located differently relative to the base and cap portions 12, 30. For further example, some or even nearly all the components described above as being located on the cap portion 30 alternatively could be physically located in a section of the base portion 12 without departing from the scope of the invention. Furthermore, it should be recognized that the base portion of the vibrator unit 10 is not required to be phallic-shaped. It could be fabricated in an alternative "female" configuration, rather than a male phallic shape; in such an alternative embodiment, the base portion 12 could be elongated and yet define a flexible, pliable, orifice shaped and sized similarly to a human vagina, in which case the vibrator unit is adapted for the insertion of an erect human penis.

The apparatus uses a special digital file, herein called a "story file," that is received, processed, and played back to the user by means of the circuit board electronics and associated peripherals. In a preferred embodiment, the story file features two main components: a soundtrack, and motor speed information.

The soundtrack is a digitally recorded audio track, containing in the preferred embodiment a verbal narration (with or without accompanying music or other background audio presentation) of an erotic story. The "story" in the preferred embodiment is an erotic narrative spoken by a narrator. The variety of story characteristics suitable for the invention is nearly endless; different stories may feature narratives of differing complexities, themes, tones, degrees of sexual explicitness, etc. A narrative may be spoken in any language, by a male or female narrator (or more than one narrator), and the narrator may employ a language or accent complementary to the story's theme or setting.

The motor speed information is a speed value list or a series of timed signals. The motor speed information signals changes in the speed of the vibrator motor(s) 16 at pre-determined points in the soundtrack playback.

To generate a story file, a story narrative soundtrack is first recorded in an audio studio. Vibrator motor speed information is then combined and coordinated with the story soundtrack using a motor-speed editing program running on a computer, which allows a story file creator (arbitrarily) to set or adjust desired motor speed throughout the soundtrack. For example, the motor-speed editing program might play-back the soundtrack to the creator while simultaneously creating a list of values representing the motor speed information, based on how the creator has positioned a graphical control (such as a slider control on a computer screen, known in the art). As the soundtrack plays back, the creator adjusts the slider control in one direction to increase the motor speed, or in the opposite direction to decrease the motor speed, to be indicated to the motor speed editing program, as desired by the creator. The motor speed editing program captures the position information from the on-screen slider, and translates that position information into motor speed information which then is added to the list of motor speed values. The creation and implementation of a suitable motor-speed editing program is within the capabilities of a programmer of ordinary skill in the software arts. A motor-speed editing program can execute in a variety of modes, and the steps are generally routine, particularly since most recorded soundtracks are (or easily can be) provided with a simultaneous timing routine.

The output of the motor-speed editing program is a story file, which in the preferred practice is a file containing both the soundtrack and the motor speed information. The story file is recorded in any suitable digital media, for later duplication and playback. A story file optionally could be encrypted, using known encryption techniques, at the time of creation. Playback of the story file is by the means of the disclosed apparatus.

An overview of the general mode of using the apparatus, including a preferred embodiment of the vibrator unit 10, is now provided by way of further explanation of the invention.

An end user accesses a given story file by first obtaining (purchasing) the apparatus, which is the playback device. The end user then acquires (again, typically by authorized purchase) the story file for playback in the apparatus. Delivery of a story file could be by tangible means (e.g., by a digital compact disk or a portable flash drive conveyed by mail), or could be via electronic transmission (e.g., file download via Internet, file as an e-mail attachment, or the like). In a preferred embodiment, if the end user receives a story file in a medium other than a portable memory device or flash drive, the user then copies the story file from the received medium onto such a portable non-volatile memory device, such as a USB flash drive. The end user then connects the USB flash drive (or similar; see element 42 in FIG. 8) containing the story file to the connector port 36 on the vibrator unit 10. (An adapter cable for this connection may be used if needed).

The end user powers-on the apparatus using the power/stop button 33 on the vibrator unit 10. The LED indicator 37 turns on, green in color, to indicate to the user that the apparatus is activated. Immediately after "power on," firmware running in the microcontroller on the circuit board 32 checks for a connected portable flash drive. If a USB or other portable flash drive is found (i.e., a proper flash drive 42 is operatively connected in the port 36), and if it contains a valid story file, then the recognized story file is copied to internal non-volatile memory in the circuit board 32 (or other associated memory device) in the apparatus. Any previous file in the apparatus's internal non-volatile memory may be erased. (In sophisticated embodiments, multiple story files could be stored in the non-volatile memory of the apparatus, and additional buttons or alternate functions on existing buttons could be used to access the different stored stories. Thus, automatic erasure of a resident story file is not required, but depends upon the character of the memory.)

During the copying of the story file from the engaged portable flash drive to the internal non-volatile memory in the apparatus, the LED indicator 37 indicates orange in color; when the file copy is complete, the LED indicator changes back to green in color, notifying that the story file has been moved into the memory of the apparatus itself. (LED indicator colors are exemplary only; any desired indication color scheme may be adopted, or light-on, light-off, indications used.) The end user may then detach the flash drive from the apparatus. Disconnection of the portable flash drive from connector port 36 is not absolutely required at this point, but is ordinarily done so that the portable memory device is not in the vibrator unit 10 during use in sex play. However, less sophisticated embodiments of the apparatus may lack internal memory, in which case the story file may be transmitted directly from the portable flash drive, rather than internal memory within the apparatus, during playback.

Headphones/earphones 50 or powered speakers are plugged into the headphone connector 38, or wireless earphones, or other wireless audio playback equipment (FIG. 8) may be employed. The user then presses the play/pause button 34 to start the play of the story file. The audio story is heard by the user through the connected headphones. Meantime and simultaneously, the speed of the vibrator motor 16 is automatically modulated by the motor speed information embedded in the digital story file. The user may press the play/pause button 34 at will to pause or resume playback temporarily. Further, also according to user desire and control, the power/stop button 33 can be pressed briefly to stop playback, and to reset the story file to play back from the beginning of the story (i.e., to re-initiate the story file). The user's long press of the power/stop button 33 (e.g., in excess of about 1.5 seconds) powers-off the apparatus. Preferably, the firmware running in the microcontroller (or microprocessor) in the circuit board 32 includes a timing routine (known in the art) that directs the apparatus electronics to power-off automatically after a pre-specified period of time, for example two minutes, of apparatus inactivity (e.g., story ended, or over-extended stop/pause condition). Thereafter, the apparatus may again be powered on, and the same story can be played again, as in the preferred embodiment the apparatus's internal memory is non-volatile.

Figure 3:
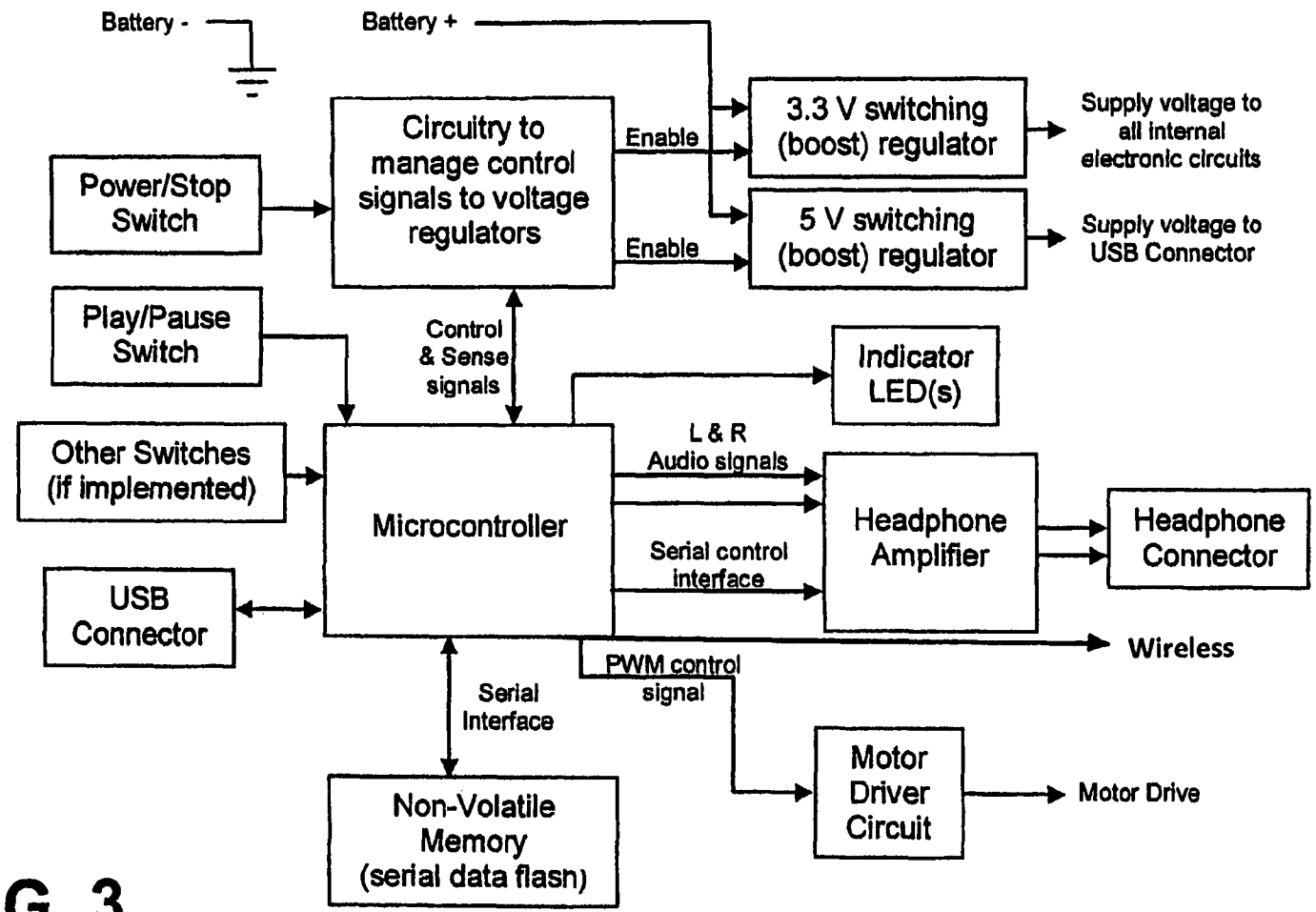
FIG. 3 is a block diagram depicting elements and functions of a possible control circuit for an apparatus and method according to the present disclosure.

Reference is invited to FIG. 3, a diagram of the elements and functions of the apparatus control circuit as may be executed on the circuit board 32 and associated components of the apparatus. The block diagram conceptualizes an overall control circuit that is similar in many respects to known conventions for a portable battery-operated audio player (such as an MP3 player), with a notable exception of the addition of at least one motor driver circuit. Most commonly available audio player microcontrollers are sufficiently powerful to handle the extra functionality of a motor control, although the present apparatus innovates with the added control of a motor. Thus, while the integration of a motor driver circuit with an audio player circuitry is a manifestation of the innovative functions of the disclosed invention, the design of electrical circuitry implementing the functions illustrated in FIG. 3 is within the capability of a person of ordinary skill in the electronic design arts. The design of the motor driver circuit itself also is known or within the scope of routine skills.

A central component of the control circuit is the microcontroller, which may be an AMTEL® UC3A0512, or other microcontroller of similar capabilities and functions. One microcontroller is shown in FIG. 3, but more than one microcontroller optionally could be used in an alternative embodiment, according to principles known in the circuit design arts. As indicated in FIG. 3, output from the microcontroller in a preferred embodiment controls the motor driver circuit by means of a pulse with modulation (PWM) control signal. The motor driver circuit, thus controlled, in turn regulates the speed of the vibrator motor 16. The microcontroller itself features a microprocessor, flash memory for storing the apparatus firmware, and RAM (as part of the microcontroller) sufficient for the needs of the firmware. The microcontroller also includes components for performing ordinary peripheral functions, such as a USB controller, a serial communications controller, PWM (pulse with modulation) controllers, PWM digital-to-analog converters for the left and right audio output signals, and the like.

In alternative embodiments of the apparatus, a separate integrated circuit could be used for the USB controller function, if an appropriate one is not integrated with the particular microcontroller being used on the circuit board 32. The connector port 36 is in communication with the microcontroller to permit data to be transmitted from a portable data device to the microcontroller. Thus the preferred configuration of the control circuit includes any of a variety of suitable non-volatile memory devices in reciprocal signal communication (via a serial interface) with the microcontroller. The serial data flash part of the preferred embodiment could be replaced by higher-capacity NAND or NOR flash devices, or even rotating magnetic media.

Referring still to FIG. 3, it is seen that left and right audio signals are transmitted to a conventional headphone amplifier; there is an ordinary serial control interface between the microcontroller and the headphone amplifier. It is understood also that alternative embodiments could include in the control circuit a CODEC/Amplifier, rather than a simple headphone amplifier. Use of a CODEC amplifier permits audio signals to be communicated in a digital format from the microprocessor. Optional wireless aspects also are depicted. Shown in FIG. 3 are a pair of switching regulators in electrical connection with the batteries 18; a 3.3-volt switching boost regulator for supplying voltage to all the internal electronic circuits, and a 5.0-volt switching boost regulator for supplying a voltage to the connector port 36. The precise configuration of the voltage regulators is not critical, and a variety of organizations may be utilized. By way of alternative example only, a single 5-volt switching/boost regulator may be used with a linear low-drop-out type regulator connected to the 5V signal, to supply the 3.3 volts needed by all the other circuit components. The control circuit also includes a management sub-circuit which, in cooperation with the power/stop button 33 or switch, exchanges control and sense signals with the microcontroller, the sub-circuit operating to manage enabling control signals directed to the switching regulators.

Alternative versions of the motor speed control may include, for example, the use of a digital-to-analog converter, rather than PWM, to produce the DC control voltage. Or, the oscillating PWM output signal (perhaps through a power driver circuit) may be applied directly to the vibrator motor 16 (as distinguished from a DC signal), while relying on the inductance of the motor coils to provide an average current (or torque or speed).

The control circuit of the apparatus accordingly is capable of recognizing, decoding, and playing audio files in a compressed format. The audio file (the "story") is recorded and encoded into any suitable format, such as MP3 format. A soundtrack in MP3 may be preferred; however, a format other than MP3 may be used for the soundtrack. Other known formats may be adapted for use, both uncompressed (e.g., WAV) and compressed (both lossless and lossy), including but not limited to FLAC (Free Lossless Audio CODEC), AAC (Advanced Audio Coding), OOC/Vorbis, or the like. The encoded soundtrack has a total play time determined at the time of creation. The encoded soundtrack file is used as a reference to create a corresponding list of values for the speed of the vibrator motor 16.

Any motor speed editing software is used to develop a sequence of vibrator motor speeds. (The motor speed values initially are zero; the motor speed editing software subsequently is used to change any or all of the motor speed values.) A list of motor speed values is generated, and then correlated chronologically with timing data for the soundtrack. In one possible embodiment, the total play time of the soundtrack is divided into one-tenth second (0.1 sec) time intervals, and an associated motor speed value is assigned to each of the time intervals. Divided time intervals of 0.1 sec are by example only. The period length of the time intervals into which the soundtrack is divided is somewhat arbitrary, and can be selected to adapt apparatus performance as desired. The resolution in the timing of motor speed changes, relative to the audio playback, alternatively may be less precise, but would be unnoticed by the end user. Thus, somewhat longer intervals, such as 0.2 sec intervals, alternatively may be used.

Each motor speed value, in the sequence of values, represents a percentage of full motor speed (maximum design operating speed). By way of example, the motor speed values may range from zero to 1000. A speed value of zero represents the vibrator motor turned completely off, while a value of 1000 represents maximum motor speed. Motor speed values between zero and 1000 represent intermediate motor speeds. For example, therefore, a motor speed value of 120 may represent 12% of full motor speed, while a value of 500 would represent 50% motor speed. The motor speed values and associated speed percentages are exactly coordinated, but the actual speed achieved in the vibrator motor 16 may not correlate precisely to a designated value due to variations in motor behavior, circuit tolerances, and the like. It should be recognized that assigning a range of 0-1000 to the available motor speed values is by way of typical example, not limitation. A preselected range of values from zero to 1000 may be chosen to provide an approximately 0.1% resolution in motor speed control. If a greater control resolution is desired, it may be achieved by adopting a motor speed values range of 0-10,000, for example. The choice and programming of the range of motor speed values is an implementation choice (but one which may affect the cost of apparatus components).

It is appreciated by one skilled in the art that, while the motor speed values are intended to represent a specific percentage of full motor speed, the actual RPM (or other speed dimension, such as Hz) achieved in the vibrator motor 16 normally varies due to such factors as the type of vibrator motor used, the tolerance of the motor parameters (e.g., coil resistance, torque constant, bearing friction), circuit tolerances, circuit variations, and circuit specifics, and of course the actual voltage of the batteries 18. As a result of these variables, a particular motor speed value does not necessarily compel a specific or precise actual motor speed. But in most embodiments of the invention, there is an approximately proportional relationship between programmed motor speed value and actual vibrator motor speed achieved. The relationship is repeatable (within reasonable and ordinary variations in battery voltage, etc.), resulting in a relationship between motor speed value and actually achieved motor speed that is acceptable for the objects of the invention.

A hypothetical but illustrative example of a list of motor speed values for an MP3 track with a short total play time of 5.3 seconds is provided in FIG. 4. The figure shows the coordination between the cumulating soundtrack play time intervals and the motor speed values, a coordination which is encoded within the story file. Two additional columns of data are provided in FIG. 4. The third column shows the percentage of full motor speed represented by the corresponding motor speed value in the second column. The fourth column of FIG. 4 indicates when a change to a different motor speed occurs. A given motor speed change is associated with a given playback time interval; for the example in FIG. 4, for instance, the first change to a new vibrator motor speed occurs at time 0.7 sec, when the motor speed value changes from zero to 121, signaling a motor speed increase from zero to about 12.1% of full motor speed.

Figures 5, 6:
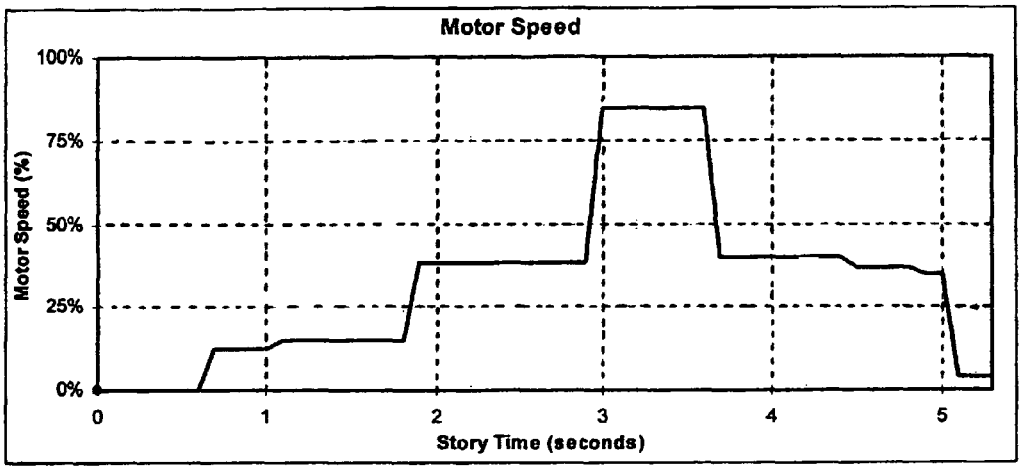
FIG. 5 is a graph, plotting a portion of the data shown in FIG. 4, showing motor speed percent (of full speed) as a function of time.
FIG. 6 is a table showing how the data from FIG. 4 can be usefully compressed.

FIG. 5 is a graphical representation of the data from the table of FIG. 4, and depicts the motor speed (as a percentage of full motor speed) as a function of time (from zero to total playback time of 5.3 seconds). It is noted that for the given soundtrack, only the list of motor speed values shown in FIG. 4 are needed to define completely the motor speeds throughout the playback. The time values (being standardized in this example to 0.1 second intervals) do not need to be recorded anywhere; rather, they are implicit in the design. Thus, for the 5.3-second soundtrack file in the example of FIGS. 4 and 5, fifty-four motor speed values need to be recorded, combined with the audio data, and stored as a digital story file.

It is observed that the plot of FIG. 5 also may illustrate, conceptually and generally, the activity expressed in a spoken story, in which the perceived level of drama, emotion, or action is a function of time as the story progresses. Thus the story begins with mild descriptions of scene and circumstance, and character development. The story then builds in conflict or excitement, reaches yet a higher level of emotion or involvement, and then reaches a climax, which is followed by the decreasing excitement which accompanies story resolution and conclusion. Sexual activity typically follows a similar pattern of gradually increasing sensual intensity, culminating in a climax followed with a relaxing postlude of decreasing levels of stimulus and involvement.

It is evident that the spoken narrative of a story, played as a story file according to this invention, can be scripted to coordinate not only with the level of physical stimulation provided by changing vibrator motor speeds, but with a listener's emotional/physiological/psychological response to the subjective content of the story. "Subjective content" is the message heard and recognized by the user as a result of her higher-order brain functions; it is spoken language in the case of a verbal narrative, and it is the exquisite mix of melody, rhythm, harmony and beat in the case of music. Subjective content such as suggestive language and/or verbal descriptions of pleasurable locations/circumstances, interpersonal encounters, erotic/sexual activity, which preferably forms all or part of the story in a story file, has varying levels of perceived intensity or explicitness. By coordinating (as a function of a common timeline) the vibrator motor speed with appropriate portions of the story's narrative, the story file in the practice of the invention automatically matches the vibrator speed to the mood or tenor of the subjective content at a given point in the playback timeline; typically, the more fervent or passionate the erotic or sexual message being heard through the user's headphones 50, the faster the vibrator motor 16 operates to provide automatically a correlated level of physical stimulation from the vibrator unit 10. Because the vibrator response is automatic, there is no need for active intervention by the user to adjust motor speed.

It is evident from the foregoing that the list of motor speed values potentially could become quite large for any soundtrack with relatively lengthy total play time. This leads to comparatively "bulky" story files for long story narratives. For example, there may be approximately 12,000 motor speed values for a 20-minute audio track. It is desirable, therefore, in the practice of the preferred embodiment of the invention, to reduce the size of the required list of motor speed values. The reduction may be accomplished by abbreviating the list of motor speed values. A compressed version of the motor speed values list is created to contain only the values representing an actual change in motor speed, along with the corresponding times at which each such speed change occurs. The motor speed values list of FIG. 4 accordingly could be compressed to make the simpler showing of FIG. 6.

In a preferred mode of practicing the invention, a compressed list similar to that of FIG. 6 is thus employed. In such instance, both the running time values ("timestamps") and the motor speed values are recorded and stored. The total count in the simple example of FIG. 6 is eighteen values—considerably less than the 53 values in the uncompressed list of FIG. 4. The reduction in number of recorded values in this comparison of simple examples is not tremendous. However, desirable story files in a preferred practice of the invention more realistically have a total running play time of ten minutes or more, and ordinarily would have fewer speed changes (per unit time) than in this hypothetical example. Consequently, in the practice of a preferred embodiment of the invention, the use of the described "compressed" file methodology results in a beneficial savings in number of stored time and motor speed values.

An apparatus according to the present disclosure preferably thus uses a compressed list format as described above, with an approximate limit of about 2048 paired "entries." Each "entry" consists of one timestamp value and one corresponding motor speed value. In memory, each value is represented by a 16-bit unsigned integer, for a total data size of 8192 bytes. Alternate embodiments could use different numbers of bits for each of the values or, in yet another alternative embodiment, a different number of entries.

It may be desirable, although not required, to implement a compressed list of timestamp and motor speed values that is uniformly 2048 entries in length, between apparatuses, and with reduced regard for the actual total play time of a particular recorded story file. Many stories may not have many motor speed changes, and thus no need for such a lengthy list of entries. In such instances, unused entries may be assigned a time value equal to the maximum value of a 16-bit unsigned integer; the firmware residing in the microcontroller on the circuit board 32 accordingly is designed to recognize these as unused entries.

The maximum value of a "used" timestamp can be one less than the maximum value of an unsigned 16 bit integer, or 65,534, which corresponds to a timestamp of 6,553.4 seconds. This places a time limit on the audio track (in one possible embodiment) of slightly over 109 minutes total play time. The internal non-volatile memory in an apparatus places a practical limit for length of the audio track in the range of 20-40 minutes. The choice of integer values for the motor times list therefore is adequate.

Figure 7:
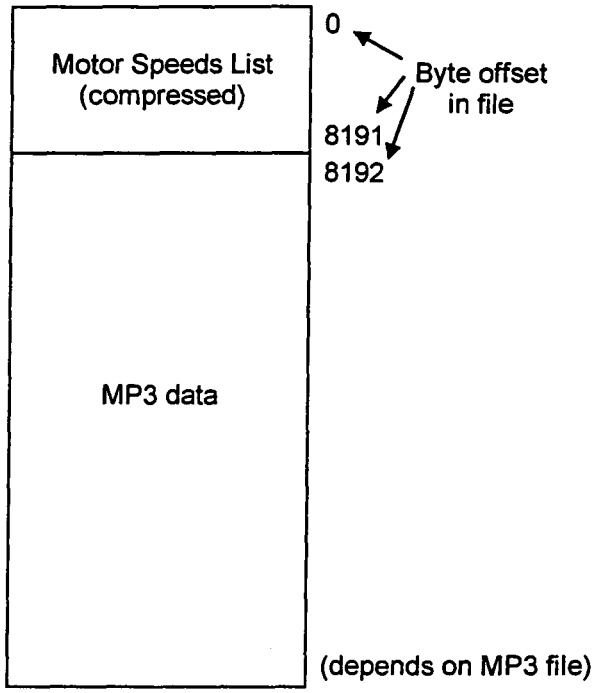
FIG. 7 is a diagrammatic illustration of the basic structure of a possible version of a file containing a combination of motor speed information and soundtrack data according to the present disclosure.

After a compressed list of motor speed values is created, it is combined with the soundtrack file to create the single digital "story file" containing both the audio track and the motor speed information. In the combination, the 8192-byte compressed motor speeds list (e.g., similar to FIG. 6) is prepended to the soundtrack audio file. The resulting story file is no longer solely an audio format (though, strictly speaking, a subset of it is). The resulting story file has a byte "offset" as illustrated in FIG. 7. The byte offset numbers provided in FIG. 7 are informational labels in that figure merely to promote an understanding of this one example file. The byte offsets are actually inherent in the file, in the sense that they simply correspond to the location of the various bytes in the file.

An even more compressed optional version of the motor speed information may be simply the information in the second column of FIG. 6, embedded directly into the soundtrack file at approximately the positions (in the soundtrack file) corresponding with the timestamp values in the first column of FIG. 6. Advantageously, the timestamp values would not have to be included in the story file reducing the overall file size even further, and would have the advantage of creating a file format more difficult to duplicate without authorization. The firmware in the apparatus would be devised to "know" where to find the motor speed values, so they could be extracted/separated from the soundtrack during playback; one skilled in the art could readily devise such a method.

The compiled story file is stored on a portable memory medium, such as a flash drive. In the use of the apparatus, the user inserts the flash drive 42 (FIG. 8) into the portable memory device port 36, and copies the story file to the internal non-volatile memory provided on the circuit board 32. This copy process is accomplished by known technologies such as file copy/paste techniques on data storage devices incorporating FAT formats.

In a preferred embodiment of the apparatus including the vibrator unit 10, immediately after the apparatus is powered on using the power/stop button 33, firmware on the circuit board 32 automatically checks for and recognizes if a portable drive is attached in the port 36. If a recognized story file is detected on the portable drive, it is copied to the apparatus's internal non-volatile memory—in the simplest version of the apparatus thus erasing any (potentially different) digital story file which may have previously been stored there.

After a selected story file has been transferred to and resides in the internal non-volatile memory on the circuit board 32, it is "played back" utilizing techniques known in the art for searching for and accessing files within a non-volatile memory. Initiation of a story file playback is by the user's pressing the play/pause button 34, which signals actuation to the control circuit.

A capability of the apparatus is the playback of the story file, with a separation of the file data into motor speed control and soundtrack. According one version of the present invention, the first 8192 bytes representing the compressed listing of motor speed data from the story file are read into a portion of the microcontroller's static RAM memory. The audio playback firmware (which is well known technology, particularly for MP3 formats) is directed to the 8183$^{rd}$ byte as the start of the soundtrack data. The playback firmware reads in and decodes the remaining soundtrack portion of the story file, just as it would a conventional (e.g., MP3) file. The playback firmware occupies less than 100% of the capacity of the microcontroller on the circuit board 32, so that other portions of firmware are free to run approximately concurrently in a multi-tasking manner (concurrent multi-tasking operation being a benefit known in the art).

Firmware in the microcontroller, the "motor speed control firmware," monitors the playback progress by tracking the "elapsed time" which is made available by the playback firmware. The motor speed control firmware, the routines of which are within the ordinary skill of the programming art, compares the elapsed time to the information in the compressed motor speed values list (i.e., the timestamp value in the first column of FIG. 6). The firmware audits this comparison, so that whenever the elapsed time exceeds a timestamp entry in the motor speeds list, the vibrator's motor speed is adjusted based on the corresponding motor speed value. After an adjustment has been made corresponding to a particular timestamp value, the firmware no longer makes comparisons against this timestamp, but instead makes comparisons against the next timestamp in the list. The audio playback, with coordinated timed "updates" to the vibrator motor speed, continues until the end of the soundtrack is reached, or until the user presses a button 33 or 34 causing playback to stop.

So, to control the speed of the vibrator motor(s) 16, the apparatus firmware refers to the most recent motor speed value, and uses that value then to update the motor driver circuit. Referring again to FIG. 3, motor speed value is sent to a PWM peripheral in the microcontroller. The microcontroller of the control circuit board is programmed to generate a 0% duty cycle signal (DC 0V) with a motor speed value of 0, and a 100% duty cycle signal (DC=supply voltage) with a motor speed value of 1000. Intermediate motor speed values produce a constant frequency signal whereby the duty cycle equals the ratio of the associated motor speed value over 1000. The output signal from the PWM peripheral is fed into a low pass filter which transforms the oscillating signal to an approximately DC signal of voltage proportional to duty cycle. The DC signal is inverted (so that "zero duty cycle" equals "motor off"), which in the preferred embodiment requires the motor drive signal to be equal to the battery (positive) voltage, and then sent to the driver circuit which produces the motor drive voltage. Some non-linear transformations preferably are implemented in the firmware to promote a reasonably close match between the intended and actual motor speeds.

Some of the control circuitry preferably disposed on the circuit board 32 in the cap portion 30 alternatively could be situated remotely from the vibrator unit 10. One such a possible alternative mode for practicing the invention is depicted in FIG. 8. A base station or console 40 (e.g., a components box/console located "bedside") may be provided, containing the majority of the control circuitry (i.e., a circuit board 32) and peripherals, such as port 36. The console 40 mounts or contains most or all the control circuit and peripherals described as being housed in cap portion 30 of the embodiment of FIG. 2, including a port in which a portable flash drive (transmitting a story file) can be operatively inserted. Console 40 has an antenna and houses a transmitter for wireless communication with the vibrator unit 10 (and optionally with headphones 50, particularly if headphones 50 are not hardwired to the vibrator unit 10). The headphones 50 and/or the vibrator unit 10 include on-board receivers for receiving audio and motor control signals transmitted from the console 40. A wireless (or wired) communication with the vibrator unit 10 is provided for control of the vibrator motor 16 speed. Means for accomplishing such wireless connections are known in the electronics arts, but it is an advantage of the present invention to employ such a communication to coordinate the vibrator motor speed with a story. As suggested by FIG. 8, a sophisticated embodiment of the apparatus could feature a vibrator unit 10 having a wireless communication with a base console 40, but also the alternative or back-up option of engaging the portable memory device 42 directly with a port in the vibrator unit 10.

Also seen in FIG. 8 are the headphones 50. The headphones shown are by way of example only; the only requirement of the apparatus is the provision of a speaker by which the audio soundtrack can be rendered audible to the user. One or more "ear buds" known in the art could be used, amplified speakers could be used (such as are commonly connected to personal computers), or a more sophisticated audio playback system could be connected. The headphones 50 may have a wireless communication with the vibrator unit 10 and/or a base console 40. Communication between the headphones 50 and either the base console 40 or the vibrator unit 10 alternatively or additionally could be by means of a conventional hard wiring 52 connectable with suitable inputs (e.g. headphone jack 38 in the vibrator unit 10, or similar input port on the console 40).

Pursuant to the foregoing, there is provided generally an apparatus for providing simultaneous vibratory and audio sensory stimulation having a control circuit and at least one vibrator motor whose operating speed is responsive to signals from a motor driver circuit. The control circuit features at least one microcontroller, a motor driver circuit in signal communication with the at least one microcontroller, input means (e.g., a flash drive port 36 and its circuit) for transmitting at least one digital data file into at the least one microcontroller from an external data source (e.g., a portable memory device 42), wherein the at least one data file contains motor speed information and a soundtrack, and output means (e.g., an amplifier with serial control interface) for transmitting signals from the at least one microcontroller to an audio speaker (such as the speaker(s) in headphones 50), to render audible the soundtrack. The microcontroller is programmable to process the at least one digital file to signal the motor driver circuit to modulate the motor operating speed to coordinate arbitrarily the motor operating speed with a content of the soundtrack.

There more specifically is provided more specifically a vibrator apparatus for enhancing sexual stimulation featuring a control circuit having a microcontroller, a motor driver circuit in signal communication with the microcontroller, and input means for transmitting at least one digital data file (a "story file") into the microcontroller from an external data source, wherein the at least one data file contains motor speed information and a soundtrack of a verbal narrative. The control circuit also has output means for transmitting signals from the microcontroller to an audio speaker to render audible the verbal narrative. The vibrator apparatus particularly includes at least one vibrator motor whose operating speed is responsive to signals from the motor driver circuit. The microcontroller is programmable to process the at least one digital story file to signal the motor driver circuit to modulate the motor's operating speed to coordinate the operating speed with a subjective content of the audible narrative.

Alternatively, the input means for transmitting the at least one digital file may be a wireless transmitter and receiver; the transmitter may be located remotely from the vibrator unit 10, while the receiver 35 may be on the vibrator unit. Similarly, the output means for transmitting signals to the speaker may be a wireless transmitter, with a receiver provided near the speaker, such as in a set of headphones 50 equipped with an antenna as known in the art.

In a preferred embodiment, the "story file" data file features a list of time intervals (timestamps) and the motor speed information includes a motor speed values list coordinated with the time intervals, with each motor speed value representing a percentage of maximum vibrator design operating speed. Preferably, the list of time intervals is compressed to contain only intervals at which a change in motor speed occurs, and the motor speed values list is compressed to contain only values corresponding to those pre-selected motor speed changes.

Also, the signals transmitted from the microcontroller to the motor driver circuit preferably are pulse with modulation control signals. Alternatively, the signals from the microcontroller to the motor driver circuit may be direct current control voltages produced by a digital-to-analog converter within the control circuit.

Alternative versions of the invention may embody or employ other aspects and methodologies for accomplishing the object of coordinating the vibrator motor speed to the content of the soundtrack. Most notably, it is possible in an alternative mode of practicing the invention to encode and combine the motor speed information directly with the soundtrack, instead of having two distinct portions of the story file (i.e., a motor speed values list and a soundtrack). By way of general example, the compression format could be modified to include a motor speed value in each "frame" (as known to those skilled in the art) of encoded data; this speed value would be extracted during the audio decode process and used to adjust the motor speed. Or, the vibrator motor speed could first be encoded into the analog audio signals (e.g., at a sub-harmonic or DC level), and then the analog audio could be compressed/encoded to digital. A reverse could be implemented to extract the motor speed information from the analog audio signals.

As mentioned previously, the vibrator unit 10 may feature more than one vibrator motor 16, if desired, and each motor can be independently "driven." Two or more motors can be independently set to arbitrary speeds by multiple, separate sets of speed information in the programmed story file. In such a case there is still one microcontroller, but there are multiple motor driver circuits. In this regard, it is noted that most microcontrollers of the class able to decode sound files have multiple PWM outputs, and thus can easily control more than one motor simultaneously.

The foregoing disclosures are of possible and preferred embodiments of the invention. Other alternative embodiments will be apparent to a person of ordinary skill in the art, and a variety of embodiments are within the scope of the invention. The described motor speeds list (compressed or not) and the mode for combining the motor speeds list with a digital audio file are not delimiting. The motor speed values list could be any appropriate size, or in some other format, or could be compressed (such as by known "zip" compression).

It also is contemplated that in more sophisticated embodiments of the apparatus, means could be provided for modifying the motor speed in response to the motor speed value. Most apparently, buttons could be added to the vibrator unit 10 (or existing button functions modified) to allow the user to modify the relationship between the motor speed value and the RPM of the vibrator motor 16. A simple linear transformation could be implemented, in the control circuitry of the circuit board 32, with a gain and offset. The user, using buttons on the apparatus, is given control of the gain and offset values, thus permitting her to adjust proportionally the vibrator motor speed as a function of the motor speed values. Or, instead of buttons, a simple potentiometer may be disposed in the control circuitry, which could adjust the gain value. The incorporation of a potentiometer, however, has the effect of reducing the overall range of the motor speed (e.g., by limiting maximum RPM).

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. An apparatus for providing simultaneous vibratory and audio sensory stimulation comprising:

a control circuit comprising:

at least one microcontroller;

a motor driver circuit in signal communication with the at least one microcontroller;

means for transmitting at least one digital data file into the at least one microcontroller from an external data source, wherein the at least one data file contains motor speed information and a soundtrack; and means for transmitting signals from the at least one microcontroller to an audio speaker to render audible the soundtrack; and at least one vibrator motor whose operating speed is responsive to signals from the motor driver circuit;

the microcontroller being programmable to process the at least one digital data file to signal the motor driver circuit to modulate the motor operating speed to coordinate arbitrarily the motor operating speed with a content of the soundtrack.

2. An apparatus according to claim 1 wherein the at least one vibrator motor is disposed within the base portion of a sex toy.

3. An apparatus according to claim 2 wherein the control circuit is disposed within a cap portion of a phallic-shaped sex toy.

4. An apparatus according to claim 2 wherein the control circuit is disposed within a base console situated remotely from the base portion.

5. An apparatus according to claim 1 wherein the means for transmitting at least one digital data file comprises a portable data device port.

6. An apparatus according to claim 1 wherein the means for transmitting at least one digital data file comprises a wireless transmitter and receiver.

7. An apparatus according to claim 1 wherein the means for transmitting signals comprises a wireless transmitter and receiver.

8. An apparatus according to claim 1 wherein the data file comprises a list of time intervals and the motor speed information comprises a motor speed values list coordinated with the time intervals, each motor speed value representing a percentage of maximum vibrator design operating speed.

9. A vibrator apparatus for enhancing sexual stimulation comprising:

a control circuit comprising:

a microcontroller;

a motor driver circuit in signal communication with the microcontroller;

means for transmitting at least one digital data file into the microcontroller from an external data source, wherein the at least one data file contains motor speed information and a soundtrack of a narrative; and means for transmitting signals from the microcontroller to an audio speaker to render audible the narrative; and a vibrator motor whose operating speed is responsive to signals from the motor driver circuit;

the microcontroller being programmable to process the at least one digital data file to signal the motor driver circuit to modulate the motor operating speed to coordinate the motor operating speed with a subjective content of the audible narrative.

10. An apparatus according to claim 9 wherein the means for transmitting at least one digital data file comprises connector port to permit data to be transmitted from a portable data device.

11. An apparatus according to claim 9 wherein the means for transmitting at least one digital data file comprises a wireless transmitter and receiver.

12. An apparatus according to claim 9 wherein the means for transmitting signals comprises a wireless transmitter and receiver.

13. An apparatus according to claim 9 wherein the data file comprises a list of time intervals and the motor speed information comprises a motor speed values list coordinated with the time intervals, each motor speed value representing a percentage of maximum vibrator design operating speed.

14. An apparatus according to claim 13 wherein the list of time intervals is compressed to contain only intervals at which a change in motor speed occurs, and the motor speed values list is compressed to contain only values corresponding to the motor speed changes.

15. An apparatus according to claim 9 wherein signals from the microcontroller to the motor driver circuit comprise pulse with modulation control signals.

16. An apparatus according to claim 9 wherein signals from the microcontroller to the motor driver circuit comprise direct current control voltages produced by a digital-to-analog converter.

17. An apparatus for providing simultaneous vibratory and audio sensory stimulation comprising:

a control circuit comprising:

a microcontroller;

a motor driver circuit in communication with the microcontroller; and at least one data file, transmittable into the microcontroller from an external data source, containing motor speed information and a soundtrack defined by audio signals;

an audio speaker to render audible soundtrack audio signals transmitted from the microcontroller to; and a vibrator motor whose operating speed is responsive to control signals from the motor driver circuit;

wherein the microcontroller processes the at least one data file to control signal to the motor driver circuit the motor speed information to coordinate the motor operating speed with the soundtrack, whereby motor operating speed is not a function of an audio signal waveform.

18. The apparatus of claim 17 wherein the at least one data file comprises a list of sound track play time intervals and the motor speed information comprises a list of motor speed values coordinated with the play time intervals, wherein each motor speed value is associated with a play time interval.

19. The apparatus of claim 18 wherein the list of play time intervals comprises a compressed list of time intervals containing only time intervals at which a change in motor speed occurs, and the list of motor speed values comprises a compressed motor speed values list containing only speed values corresponding to motor speed changes.

20. The apparatus of claim 19 wherein the soundtrack comprises a spoken narrative, and motor operating speed is automatically matched to subjective content of the narrative by correlating chronologically the motor speed values with the time intervals.

* * * * *